US006191929B1

(12) United States Patent
Hoffmann et al.

(10) Patent No.: US 6,191,929 B1
(45) **Date of Patent: *Feb. 20, 2001**

(54) CONTROL DEVICE FOR AN INTERNAL COMBUSTION ENGINE

(75) Inventors: Christian Hoffmann, Regensburg; Richard Wimmer, Parnkofen; Achim Koch, Tegernheim, all of (DE)

(73) Assignee: Siemens Aktiengesellschaft, Munich (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/133,705

(22) Filed: Aug. 13, 1998

Related U.S. Application Data

(63) Continuation of application No. PCT/DE96/02187, filed on Nov. 18, 1996.

(30) Foreign Application Priority Data

Feb. 13, 1996 (DE) ..... 196 05 244

(51) Int. Cl.[7] ..... H01H 47/04
(52) U.S. Cl. ..... 361/152; 361/154
(58) Field of Search ..... 361/152–154, 361/160, 170, 182; 324/418–423; 340/644

(56) References Cited

U.S. PATENT DOCUMENTS

| | | | | |
|---|---|---|---|---|
| 4,851,959 | * | 7/1989 | Stumpf | 361/160 |
| 4,950,985 | * | 8/1990 | Voss et al. | 361/170 |
| 4,970,622 | * | 11/1990 | Buchl | 361/154 |
| 5,053,911 | * | 10/1991 | Kopec et al. | 361/154 |
| 5,172,298 | * | 12/1992 | Shimizu et al. | 361/152 |
| 5,196,983 | * | 3/1993 | Stumpf | 361/154 |
| 5,204,633 | | 4/1993 | Ahladas et al. . | |
| 5,293,551 | * | 3/1994 | Perkins et al. | 361/154 |
| 5,668,693 | * | 9/1997 | Tennies et al. | 361/154 |
| 5,774,323 | * | 6/1998 | Innes et al. | 361/187 |

FOREIGN PATENT DOCUMENTS

| | | |
|---|---|---|
| 31 50 814 A1 | 6/1983 | (DE) . |
| 0 400 389 A2 | 12/1990 | (EP) . |
| 0 603 655 A2 | 6/1994 | (EP) . |
| 2 041 659 | 9/1980 | (GB) . |
| 2 275 541 | 8/1994 | (GB) . |
| 62-225742 | 10/1987 | (JP) . |
| 4-287850 | 10/1992 | (JP) . |

* cited by examiner

*Primary Examiner*—Fritz Fleming
(74) *Attorney, Agent, or Firm*—Herbert L. Lerner; Laurence A. Greenberg; Werner H. Stemer

(57) ABSTRACT

A control device includes a magnetic actuator, a final control element, a regulating unit and a measuring device. The magnetic actuator has a coil, a core, and an armature. The actuator is connected to the final control element. The measuring device determines an inductance value L of the coil and generates, as a function of the inductance value L, a first control signal by which a theoretical value of the amplitude of the current through the coil is changed to a holding value. When a pulse signal P is present, the current through the coil is regulated to the theoretical value by the regulating unit.

6 Claims, 3 Drawing Sheets

CONTROL DEVICE FOR AN INTERNAL COMBUSTION ENGINE

CROSS-REFERENCE TO RELATED APPLICATION

This is a continuation of International Application No. PCT/DE96/02187, filed on Nov. 18, 1996, which designated the United States.

BACKGROUND OF THE INVENTION

Field of the Invention

The invention relates to a control device for an internal combustion engine. The control device has a magnetic actuator with a coil and an armature, a final control element connected to the armature, a regulating unit for regulating a current in the coil and a measuring device for generating test signals which act on the coil.

A control device including an actuator having a coil, a core and an armature, a final control element and a regulating unit are described in Published European Patent Application EP 0 400 389 A2. To attract the armature to the core, the coil is supplied with an attraction current which has an amplitude that is large enough that the force required to accelerate and move the armature is available through the magnetic flux. When the armature abuts against the core, the current through the coil is limited to a holding current. An amplitude of the holding current is provided so that at least a holding force required to hold the armature on the core is applied through the magnetic flux.

The current through the coil is reset by an on-off controller to the respective theoretical value of the attraction current or of the holding current. In this case, the pulse/pause ratio of the actuation signal is dependent upon the attainment of an upper and a lower threshold value of the current.

The recognition of an instant of impact of the armature on the core has extremely great importance, since in the event of a delayed switch over to the holding current very high losses occur in the coil, which may lead to the thermal destruction thereof.

In the above-mentioned control device, the temporal duration of the pulses of the actuation signal is determined by the regulating unit and is used as an indirect measure of the inductance of the coil, which increases as the spacing between the core and the armature decreases. On this basis, the holding current is predetermined as a theoretical value when the determined time duration is above a limiting value. In this connection, it is a significant disadvantage that the instant of impact of the armature cannot be determined precisely. If the armature impinges on the core shortly before the current reaches its lower threshold value, then the impact cannot be detected until after the following pulse of the actuation signal. Accordingly, high losses arise in the coil, since the current is limited to the holding current too late. The losses can be reduced only in circumstances in which the attraction current has an appropriately low magnitude. However, this brings about an increase in the time which the armature requires to pass from a neutral position to abutment against the core. Accordingly, the final control element can no longer be driven as rapidly. This is a disadvantage, in particular in the case of injection valves or in the case of inlet/exhaust valves of an internal combustion engine.

SUMMARY OF THE INVENTION

It is accordingly an object of the invention to provide a control device for an internal combustion engine which overcomes the above-mentioned disadvantages of the prior art devices of this general type, in which the response time and the losses of the control device are reduced.

With the foregoing and other objects in view there is provided, in accordance with the invention, a control device for an internal combustion engine, including: a magnetic actuator having a coil and an armature; a regulating unit connected to the magnetic actuator for regulating a current through the coil to a setpoint value if a pulse signal is present at the regulating unit; and a measuring device connected to magnetic actuator, the measuring device including: a signal generator for generating and supplying a test signal to the coil, the coil generating an output signal in dependence on the test signal; a measuring system receiving the output signal generated by the coil; and an evaluating device receiving the test signal and the output signal for determining an inductance value of the coil in dependence on the test signal and the output signal, the evaluating unit generating a first control signal in dependence on the inductance value, the first control signal changing the setpoint value to a holding value.

The invention is based on the finding that during the movement of the armature the inductance of the coil changes, and that when the armature resides on the core the inductance remains constant until the armature is released from the core. As a result of the determination of a change in the inductance, it is accordingly possible to determine a precise instant of impact of the armature on the core. To this end, the control device has a measuring device by which the inductance of the coil is determined and by which, as a function of the inductance, a first control signal is generated, by which the theoretical value is set to a holding value. The measuring device includes a signal generator, which generates a test signal which acts on the coil. Advantageously, the test signal has a small amplitude. Furthermore, a narrow-band test signal, the frequency of which is substantially higher than that of the current through the coil, is advantageous.

Preferably, the first control signal is generated when the inductance alters or changes by less than a lower threshold value in a predetermined time interval. The time interval can be selected to be so small that the instant of impact can be determined sufficiently precisely. It is extremely advantageous that the instant of impact can be determined independently of temperature and aging effects.

Preferably, a second control signal is generated when the inductance alters or changes by more than a predetermined upper threshold value in the time interval. As a result of this, it is also possible to precisely determine an instant of release of the armature from the core.

In accordance with an added feature of the invention, a magnitude of the current through the coil is determined in the measuring device, a position of the armature is read out from a performance graph as a function of the magnitude of the current through the coil and the inductance value.

In accordance with a concomitant feature of the invention, there is a final control element connected to the magnetic actuator.

Other features which are considered as characteristic for the invention are set forth in the appended claims.

Although the invention is illustrated and described herein as embodied in a control device for an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
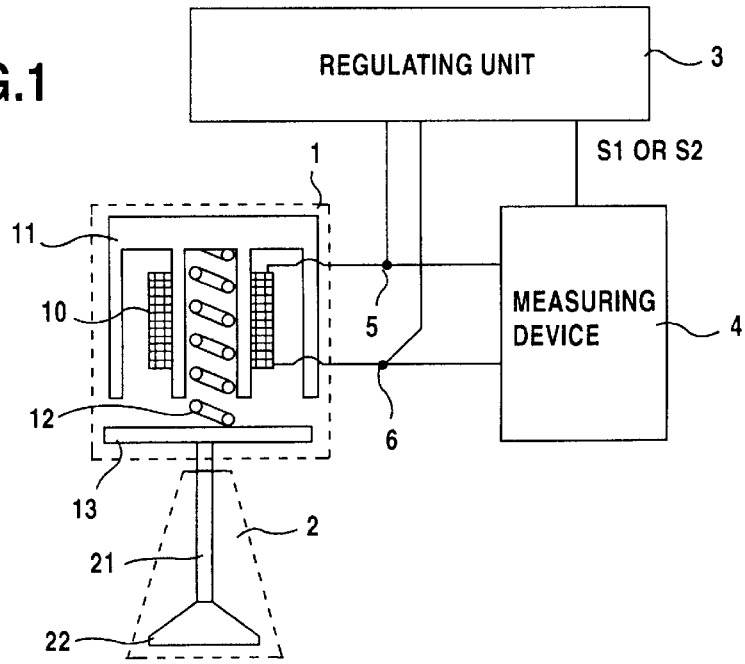
FIG. 1 is a diagram of a control device according to the invention.

Across the various figures, identical elements are identified by the same reference symbols. Referring now to the figures of the drawing in detail and first, particularly, to FIG. 1 thereof, there is shown a control device formed of an actuator 1, a final control element 2, a regulating unit 3 and a measuring device 4. The actuator 1 has a coil 10, which is wound around a core 11. A spring 12 is disposed at the core 11 in such a manner that it prestresses an armature 13 against the force direction of a magnetic force which acts when current flows through the coil 10.

The final control element 2 has a spindle 21 and a cone 22. In the embodiment, the final control element 2 is used for an injection valve or an inlet/exhaust valve of an engine. The specific construction of the final control element 2 is not essential to the invention. Accordingly, the final control element 2 can also be constructed in such a way that it can be used, for example, for a common rail system or an exhaust gas feedback system.

The coil 10 is connected, via a first tap point 5 and a second tap point 6, both to the regulating unit 3 and to the measuring device 4.

Figure 2:
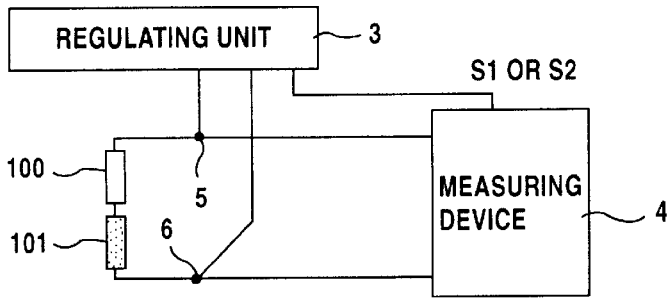
FIG. 2 is a block diagram of the control device and an equivalent circuit of an actuator.
Figure 3:
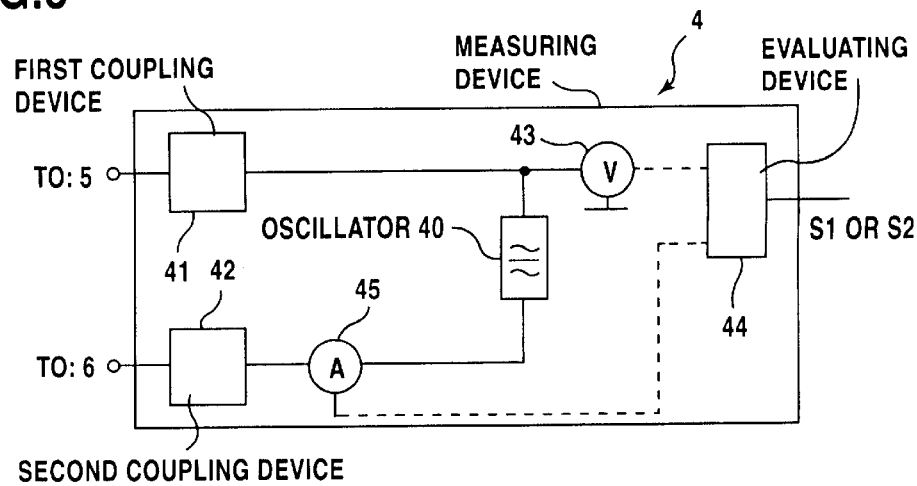
FIG. 3 is a block circuit diagram of a measuring device.

In a first approximation, the coil 10 can be represented as a series circuit of a resistance 100 and an inductance 101 (see FIG. 2). The construction of the regulating unit 3 per se is known and is not essential to the invention. Accordingly, it is not described in greater detail in the text which follows. The mode of operation of the regulating unit 3 is described with reference to FIGS. 4*a* and 4*b*.

The measuring device 4 has a signal generator which is configured as an oscillator 40 by which a test signal (hereinafter designated as a test voltage) is generated. The oscillator 40 is connected to a first coupling device 41, which is connected via the first tap point 5 to the coil 10. The first coupling device 41 is constructed, for example, as a capacitor or as a band-pass filter, the bandwidth of which approximately corresponds to that of the test voltage.

In this way, the coil 10 is acted upon by the test voltage which, in the embodiment, is a sinusoidal voltage having a markedly higher frequency than the highest frequency occurring in a control voltage with which the coil 10 is acted upon by the regulating unit 3. This ensures that an output current $I_A$ can be coupled out via a second coupling device 42, which again consists of a capacitor or a band-pass filter and which is connected via the second tap point 6 to the coil 10. The bandwidth of the band-pass filter is advantageously selected in such a way that it approximately corresponds to that of the test voltage.

The amplitude of the test voltage is predetermined in such a way that it is markedly smaller than that of the control voltage $U_S$. Between the oscillator 40 and the first coupling device 41 there is disposed a voltage meter 43, by which the magnitude of the test voltage is determined and is transmitted to an evaluating device 44.

A measuring system which is constructed as a current meter 45 is connected to the second coupling device 42 and determines the magnitude of the output current $I_A$ and transmits it as measurement signal to the evaluating device 44. In the evaluating device 44 an inductance value L of the inductance 101 is determined by the formation of the ratio of the magnitude of the test voltage to the magnitude of the output current $I_A$ and with due consideration being given to the predetermined resistance 100. The procedure is carried out at fixedly predetermined time intervals. If the inductance value L alters, within a time interval, by less than a predetermined lower threshold value, then a first control signal S1 is generated. In contrast, if the inductance value L alters, in a predetermined time interval, by more than a predetermined upper threshold value, then a second control signal S2 is generated. In the regulating unit 3, if the first control signal S1 is present a theoretical value for the coil current (magnitude) $I_S$ is reduced from an attraction current $I_{AN}$ to a holding current $I_H$.

Figure 4A:
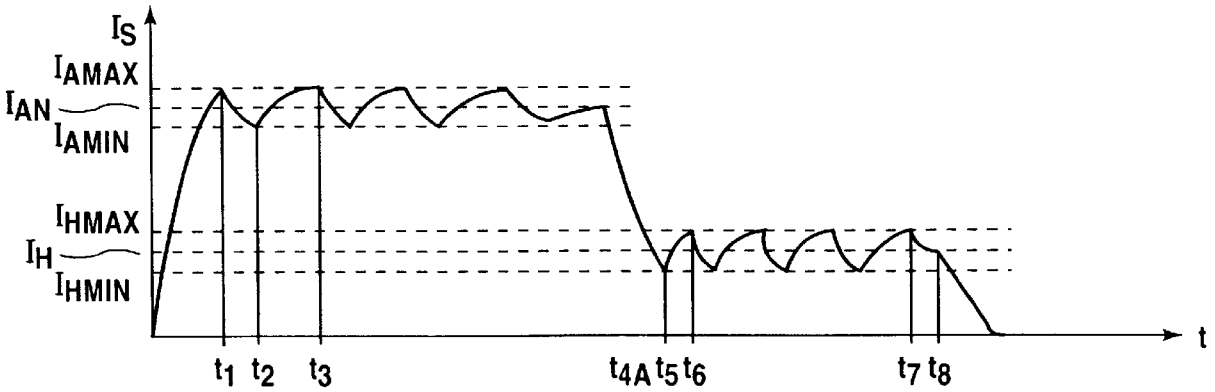
FIG. 4*a* is a graph showing a progression of a coil current plotted against time in the control device.
Figure 4B:
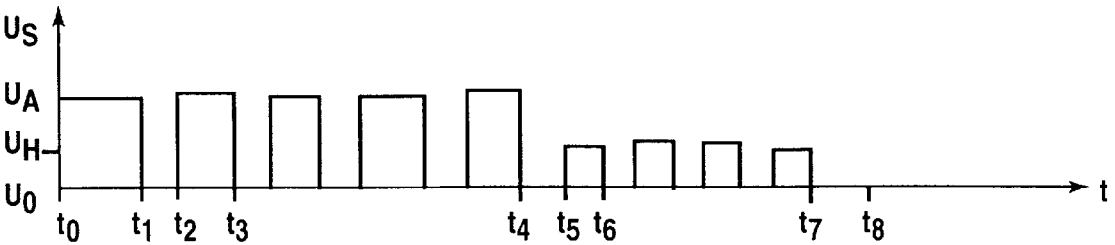
FIG. 4*b* is a graph showing the progression of a control voltage plotted against time in the control device.

FIG. 4*a* shows the progression of the coil current $I_S$ plotted against time t. At the instant $t_0$, a pulse signal P (FIG. 4*g*) is generated. Thereupon, the regulating unit 3 applies a control voltage $U_S$, which drops across the resistance 100 and the inductance 101.

The magnitude of the control voltage $U_S$ corresponds to that of the attraction voltage $U_A$. The coil current $I_S$ rises approximately exponentially until the instant $t_1$, at which it reaches the value of a maximum attraction current $I_{AMAX}$. Thereupon, the magnitude of the control voltage $U_S$ is reduced to a null voltage $U_0$ (e.g. 0 volt). The coil current $I_S$ then diminishes approximately exponentially, until, at the instant $t_2$, it has the magnitude of the minimum attraction current $I_{AMIN}$. Then, a control voltage $U_S$ having the magnitude of the attraction voltage $U_A$ is again applied at the coil 10, until, at the instant $t_3$, the coil current $I_S$ again reaches the value of the maximum attraction current $I_{AMAX}$. The procedure is continued until such time as, at the instant $t_4$, the first control signal S1 is generated.

Figure 4C:
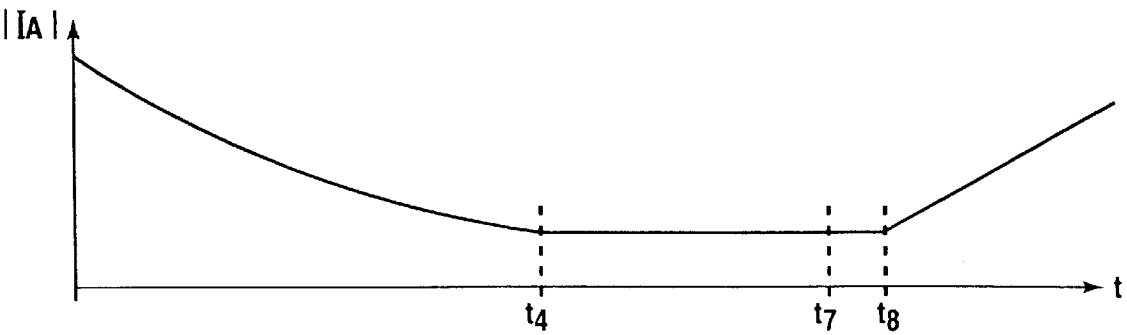
FIG. 4*c* is a graph showing the progression of an amplitude of an output current plotted against time in the control device.
Figures 4D, 4E, 4F, 4G:
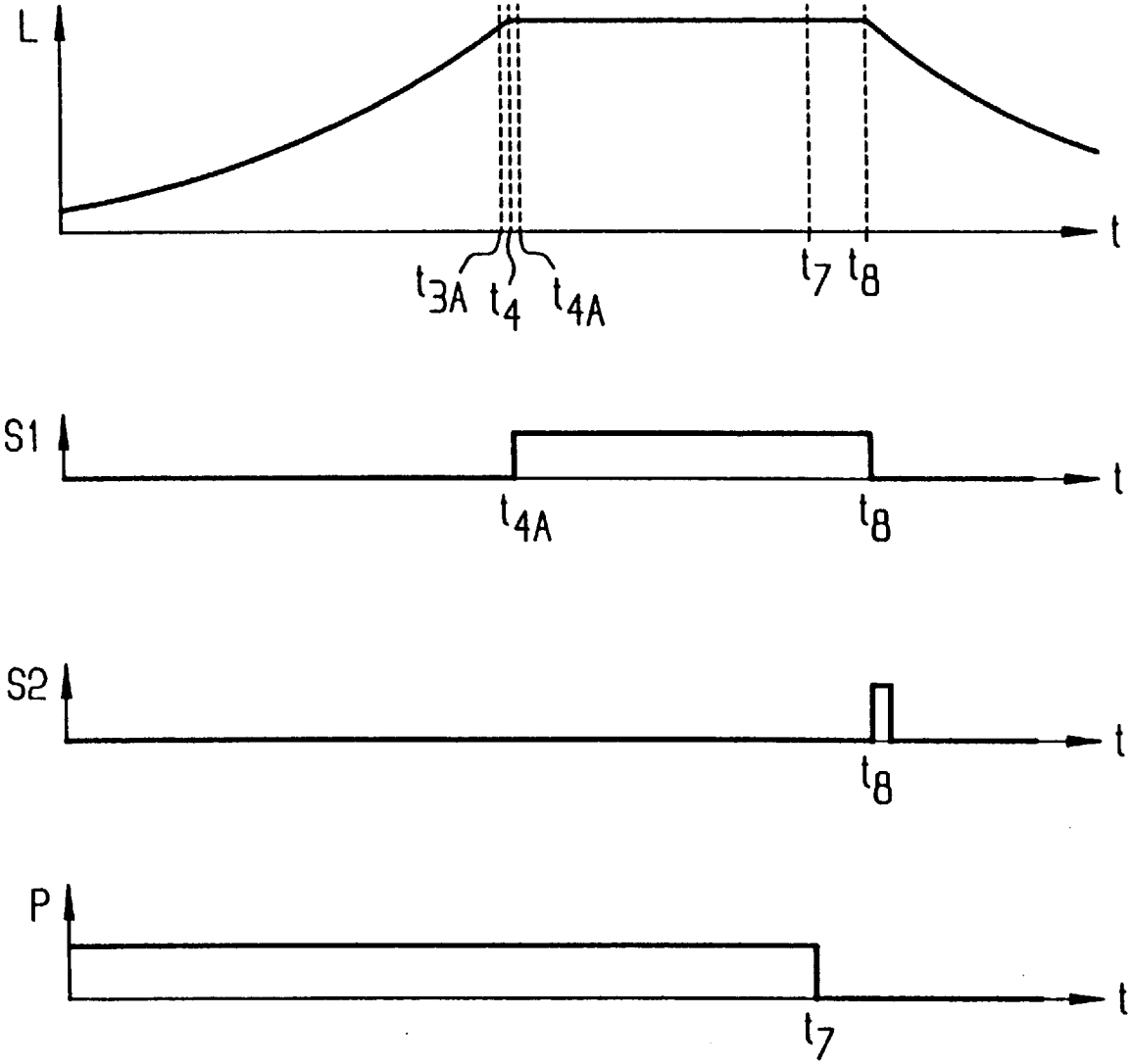
FIG. 4*d* is a graph showing a sudden flatting off of the progression of the inductance value.
FIG. 4*e* is a graph showing the progression of a first control signal plotted against time in the control device.
FIG. 4*f* is a graph showing the progression of a second control signal plotted against time in the control device.
FIG. 4*g* is a graph showing the progression of a pulse signal, plotted against time in the control device.

At the instant $t_4$, the progression of the amplitude of the output current $I_A$ (cf. FIG. 4*c*) against time has a kink. FIG. 4*d* reveals a sudden flattening off of the progression of the inductance value to an approximately constant value at the instant $t_4$. At the instant $t_{4A}$, the inductance value L has altered, in the time interval from the instant $t_{3A}$ to the instant $t_{4A}$, less than a lower threshold value. Accordingly, at the instant $t_4$ the first control signal S1 (cf. FIG. 4*e*) is generated.

The time intervals between two determinations of the inductance value L can be selected to be arbitrarily small if the lower and the upper threshold value are appropriately matched. As a result of this, the instant of impact and the instant of release can be determined with any selectable degree of precision.

At the instant $t_{4A}$, the coil current $I_S$ is reduced by an appropriate switching device, such as, for example, a freewheeling diode, as quickly as possible to a holding current $I_H$. At the instant $t_5$, the coil current $I_S$ reaches the value of the minimum holding current $I_{HMIN}$. Thereupon, the control voltage $U_S$ is set to a holding voltage $U_H$. At the instant $t_6$, the coil current $I_S$ then reaches the value of a maximum holding current $I_{HMAX}$. Thereupon, the control voltage $U_S$ is again reduced to the null voltage $U_0$ until the coil current $I_S$ reaches the value of the minimum holding current $I_{HMIN}$. The procedure is repeated until, at the instant $t_7$, the pulse signal P is withdrawn. Thereupon, the control voltage $U_S$ is set to the null voltage $U_0$ and the current through the coil is reduced by the appropriate switching device (e.g. freewheeling diode) to a null current (e.g. 0 ampere).

However, the release of the armature 13 from the core 11 does not take place until the instant $t_8$, at which the required holding force can no longer be applied by the coil current $I_S$. FIG. 4*d* reveals, at the instant $t_8$, a marked decline in the inductance value L. Accordingly, at this instant, the second control signal S2 (FIG. 4*e*) is generated.

If the test signal has a very high frequency, then the effect of the resistance 101 can be disregarded. In the event of the selection of a lower frequency of the test signal, temperature-dependent and aging-dependent alterations of the resistance 101 can be determined by appropriate resistance measuring devices. If no pulse signal P is present, a voltage can be impressed by these resistance measuring devices on the coil 10, and the steady current through the coil 10 can be determined. The ratio of these two quantities then forms the value of the resistance 100.

On this basis, the control device enables the precise determination of the instant of impact of the armature 13 on the core 11. As a result of this, it is possible to set the coil current $I_S$ close to the saturation limit of the coil 10 until the instant of impact of the armature 13, so that the armature 13 is accelerated as intensely as possible. The losses in the control device are kept very small as a result of a rapid reduction of the coil current $I_S$ from a value between the maximum attraction current $I_{AMAX}$ and the minimum attraction current $I_{AMIN}$ to the minimum holding current $I_{HMIN}$.

In a further embodiment of the invention, the measuring device 4 has a second current meter which determines the magnitude of the coil current $I_S$ and transmits this to the evaluating device 44. The measuring device 4 then has available a stored performance graph, in which base values for the position of the armature 13 as a function of the magnitude of the coil current $I_S$ and the inductance L are filed. Thus, in the case of this embodiment of the invention, the position of the armature 13 can be determined.

In a further embodiment of the invention, the measuring device 4 has a device for determining the phase difference between the test signal and the output signal. In the evaluating device 44 the inductance value L of the inductance 101 is determined from the phase difference, with due consideration being given to the predetermined resistance 100.

We claim:

1. A control device for an internal combustion engine, comprising:

a magnetic actuator having a coil and an armature;

a regulating unit connected to said magnetic actuator for regulating a current through said coil to a setpoint value if a pulse signal is present at said regulating unit; and a measuring device connected to said magnetic actuator, said measuring device including:

a signal generator for generating and supplying a test signal to said coil, said coil generating an output signal in dependence on said test signal;

a measuring system receiving said output signal generated by said coil; and an evaluating device receiving said test signal and said output signal for determining an inductance value of said coil in dependence on said test signal and said output signal, said evaluating device generating a first control signal in dependence on the inductance value, said first control signal changing said setpoint value to a holding value, said evaluating device determining a change in the inductance value, said evaluating device generating said first control signal if the change in the inductance value is less than a predetermined lower threshold value within a predetermined time interval.

2. The control device according to claim 1, wherein said evaluating device generates a second control signal if the inductance value diminishes by more than a predetermined upper threshold value within a predetermined time interval.

3. The control device according to claim 1, wherein a magnitude of the current through said coil is determined in said measuring device, a position of said armature is read out from a performance graph as a function of the magnitude of the current through said coil and to the inductance value.

4. The control device according to claim 1, including a final control element connected to said magnetic actuator.

5. The control device according to claim 1, including a valve connected to said magnetic actuator.

6. The control device according to claim 1, wherein said evaluating device determines a first inductance value and a second inductance value and takes the difference to obtain the change in the inductance value.

* * * * *